US005413301A

United States Patent [19]

Cadman

[11] Patent Number: 5,413,301

[45] Date of Patent: May 9, 1995

[54] MOUNTING HOOK AND CLIP

[76] Inventor: Bernard V. Cadman, The Twitchell, Sutton-in-Ashfield, Nottinghamshire NG17 5BT, England

[21] Appl. No.: 197,584

[22] Filed: Feb. 16, 1994

[30] Foreign Application Priority Data

Apr. 22, 1993 [GB] United Kingdom ..... 9308320

[51] Int. Cl.[6] ..... B42F 13/00

[52] U.S. Cl. ..... 248/340; 211/113; 223/87

[58] Field of Search ..... 248/215, 340, 214, 317; 211/113; 223/85, 87, DIG. 4; 206/806

[56] References Cited

U.S. PATENT DOCUMENTS

| | | | |
|---|---|---|---|
| 2,215,139 | 9/1940 | Uhlmann | 248/317 X |
| 3,329,386 | 7/1967 | Rosen | 248/340 |
| 3,790,045 | 2/1974 | Rigel | 223/87 |
| 4,155,531 | 5/1979 | Bagne | 248/340 X |
| 4,768,649 | 9/1988 | Kolton | 223/87 X |
| 4,930,692 | 6/1990 | Smilow | 223/85 |
| 5,013,004 | 5/1991 | Wilkins | 206/806 X |
| 5,222,638 | 6/1993 | Kolton | 223/85 X |

FOREIGN PATENT DOCUMENTS

| | | | |
|---|---|---|---|
| 986303 | 3/1976 | Canada | 248/340 |
| 2436453 | 5/1980 | France | 223/85 |

*Primary Examiner*—J. Franklin Foss
*Attorney, Agent, or Firm*—Young & Thompson

[57] ABSTRACT

A mounting hook and clip (30) for merchandise display incorporates a display and identification panel (37) on one of two spaced limbs (34, 37) between which a garment is entrained, for example through the intermediary of a folded mounting card (40) forming opposed side panels (41, 43), with a laterally offset locking tongue (39) on one of the elements (37) penetrating either or both slots (47, 49) in one or both card side panels (41, 43).

3 Claims, 3 Drawing Sheets

MOUNTING HOOK AND CLIP

This invention relates to mountings, fastenings and supports, such as hooks and clips, and is particularly, but not exclusively, concerned with mounting hooks and clips, such as are used in retail environments for mounting merchandise on display rack at a point of sale.

Such a display rack typically carries a stock of merchandise in an accessible array, through which a customer can browse and examine goods—if necessary by temporarily removing and replacing individual items from the rack.

A great diversity of such mounting hooks has been devised hitherto for bespoke mounting purposes, either directly or indirectly (ie through an intermediate element, as discussed later)—and of these one kind is typically moulded from synthetic plastics material configured as a shallow profiled strip.

Such plastic strips may integrate with an intervening product information and identification display mounting card, to which an individual product item (eg garment or garment set, such as a pair of socks) is attached—thus spreading the mounting loads over a larger surface area and reducing the risk of tearing of either the mounting card or indeed the fabric of the product itself.

Typically for a garment mounting, a display card is folded to embrace the garment thickness and a proprietary adhesive bonding or mechanical fastening, such as a plastics staple or rivet, is fired through the combined depth of folded card (doubled) and garment, applied in order to secure the attachment of card and garment.

However, such card has limited mechanical robustness itself and so, in order to mount the 'carded' garment upon a merchandiser display and storage rack, a supplementary integrated hook and clip element is provided for interaction with the card, rather than the garment direct.

In this way, the product (eg garment) mounting loads are spread between the plastics and card.

One earlier garment mounting hook proposal has employed a hook with depending outwardly splayed legs, to fit within a slot in a mounting card (typically at a fold in the card), by inward resiliently deformable deflection of the legs. The hook (automatically) becomes entrained in the card after passage through the card slot—by the outward restorative movement of the legs, whose ends then have a span greater than the slot width, thereby inhibiting hook separation from the card.

However, garments, mounting hooks and display cards are not necessarily produced by the same manufacturer, or on the same site, and the display information is very particular to a product. Thus some degree of laborious preliminary assembly and manual matching of the elements may be required before the product is ready for display mounting. This is relegated to an unskilled repetitive task.

In practice, problems arise with the ease of interaction and inter-fitting assembly of a disparate plastic hook element and a mounting card. That is, awkward combined twisting, card flexing actions may be required for hook clip insertion.

Thus, more specifically, the relative orientation of the hook and card must be preserved both before and after garment mounting. However, certain known mounting hook and clip configurations do not lie comfortably with a display card and may readily become dislodged or mis-orientated in bulk storage, handling and transit.

A garment mounting hook and clip according to one aspect of the present invention employs a hook extending from a shoulder, with a depending leg to penetrate one slot in a mounting card until the card abuts the shoulder and a laterally offset locking tongue to fit through another spaced slot in the card, so that the tongue emerges on the opposite side of the card, with the slot edges engaging a ledge between the leg and locking tongue and the shoulder inhibits removal of the card from the leg.

Such a hook may incorporate an enlarged panel integrated with the leg, conveniently between the shoulder and the ledge, for the display of product information.

A garment mounting hook and clip according to another aspect of the present invention comprises marginally spaced limbs defining an internal shallow depth throat region to receive a display card, with the limbs lying on opposite sides thereof, one limb incorporating a depending laterally offset locking tongue, lying generally towards or coplanar with the other limb and to locate in a slot in a display card and emerge upon the opposite side of the card to the associated limb.

Such a mounting hook and clip configuration thus embodies in one limb the depending leg and offset locking tongue of the one aspect of the invention, with a supplementary opposed bracing limb.

Again, one of the limbs may incorporate an enlarged display panel to receive product information—for example by an adhesive affixed label or by direct printing.

The other limb may comprise a peripheral frame, bounding a hollow inner region, into which the locking tongue of the other limb may lie in an undeflected condition.

In either aspect of the invention, the mounting hook is desirably integrally moulded from resiliently deformable synthetic plastics material.

There now follows a description of some particular embodiments of the invention, by way of example only, with reference to the accompanying diagrammatic and schematic drawings, in which.

Figure 1:
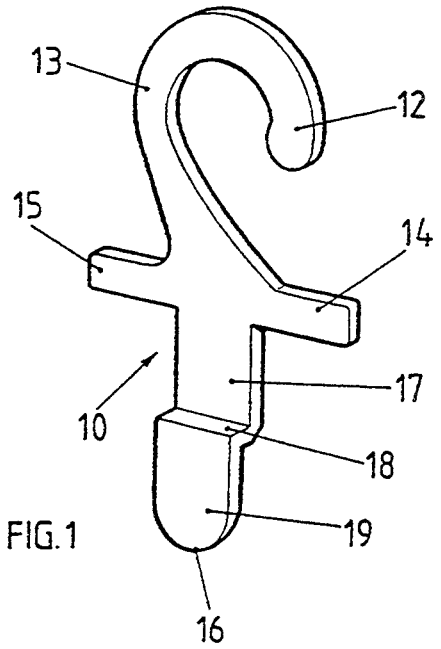
FIG. 1 shows a perspective view of a mounting hook and clip according to one embodiment of the invention.
Figure 2:
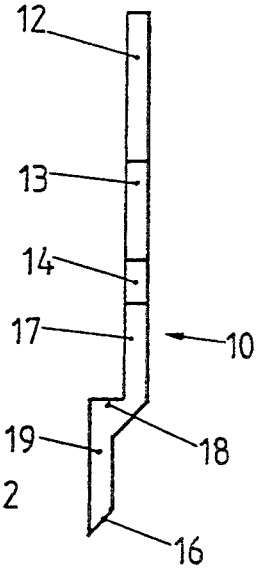
FIG. 2 shows a side elevation of the mounting hook and clip shown in FIG. 1.
Figure 3:
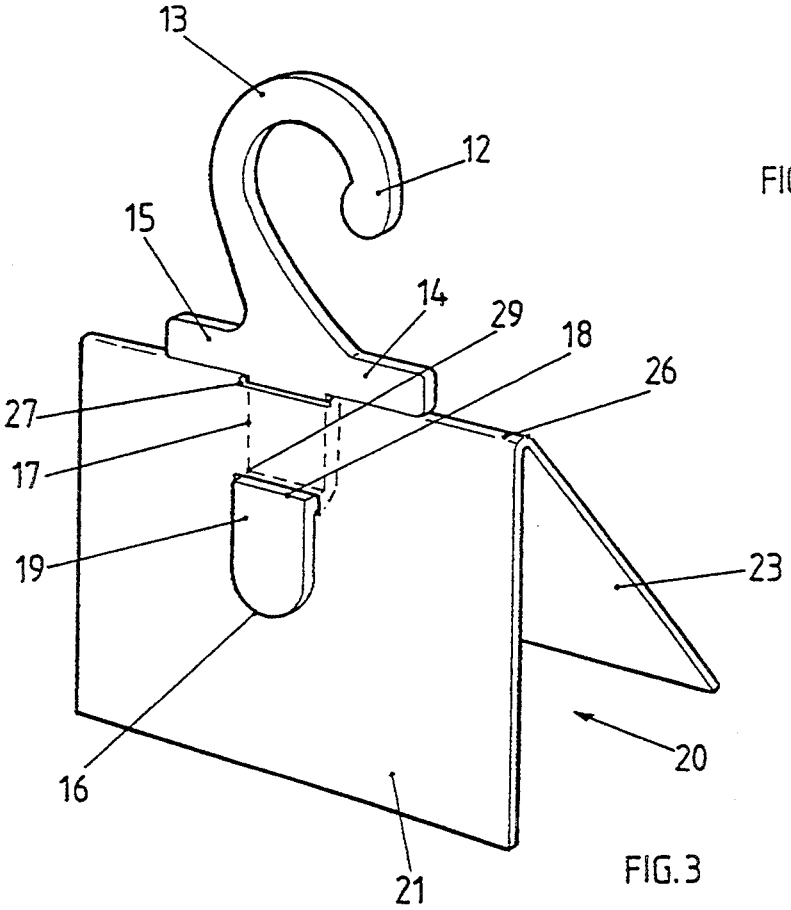
FIG. 3 shows the mounting hook and clip of FIGS. 1 and 2 fitted into a display and mounting card.
Figure 4:
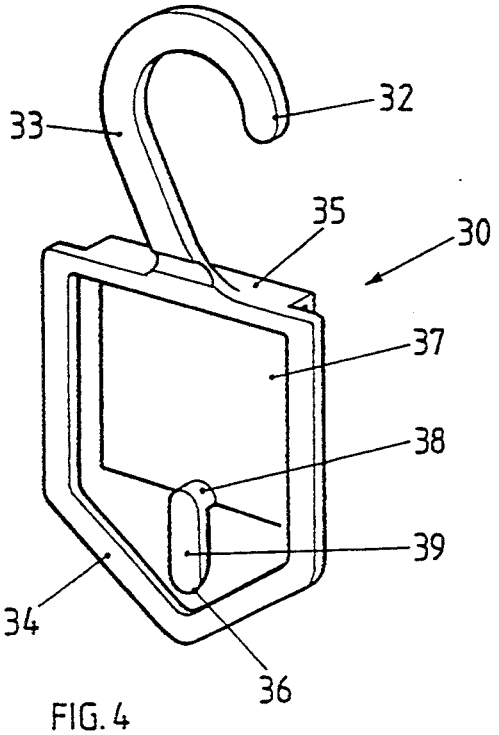
FIG. 4 shows a perspective view of an alternative embodiment of a mounting hook and clip to that shown in FIGS. 1 to 3, albeit embodying certain similar features.
Figure 5:
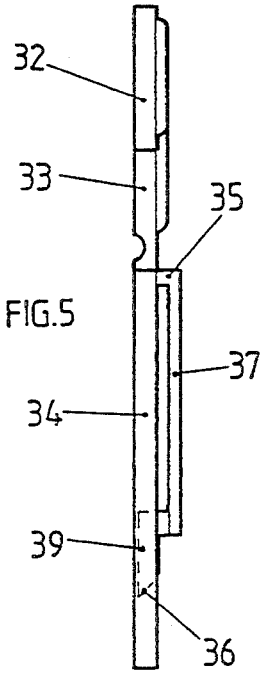
FIG. 5 shows a side elevation of the mounting hook and clip shown in FIG. 4.

Referring to the drawings, and in particular FIGS. 1 to 3, a mounting hook and clip 10 is configures for the suspension of an individual product item, such as a garment, from a merchandise display rack, and is integrally moulded from resiliently deformable synthetic plastics material.

The hook 10 incorporates a curved hook profile 13 extending from a shoulder with arms 14, 15 with a depending leg 17 and a laterally offset, or 'dog-leg', (clip) locking tongue 19.

The hook 13 is configured to hang from a protruding cantilever peg or arm, bearing the weight of an individual product item, such as a garment, and embodies a slightly enlarged re-entrant nose 12 to inhibit casual dislodgement.

The hook 10 overall is configured to co-operate with an individual product display and mounting card 20, shown in FIG. 3, and which makes direct contact with the product, such as the garment and which may be appended thereto or entrained therewith by proprietary fixings.

Such a card 20 is generally not itself sufficiently robust physically to withstand the mounting loads directly, for example by the simple provision of a mounting hole through the card thickness, without the risk of material failure, such as tearing—particularly where items may be repeatedly disturbed, and even removed and replaced from a merchandiser rack, for examination by customers.

Thus, the hook 10 forms a mechanically robust intermediary between the display card 20 and the merchandiser rack and is itself readily mounted and demounted without risk of damage.

The lower depending clip element 17, 18, 19 of the hook 10 is primarily configured to inter-fit readily and securely with the display and mounting card 20.

Typically, such a garment display and mounting card 20 is folded in two around the upper end of the garment, such as a pair of socks, and a proprietary adhesive bonding or mechanical fastening, such as a plastic 'melted' or extruded rivet strand, driven through the card and garment, without minimal intrusive damage to the garment.

FIG. 3 shows such a folded mounting card arrangement, with mutually splayed panels 21, 23 on opposite sides of a (central) fold 26, which incorporates profiled as a shallow slot 27, to receive the leg 17 of the mounting hook and clip 10.

Spaced (lower down) along one of the panels 21, and vertically aligned with the upper fold slot 27, is another such shallow slot 29, to receive the locking tongue 19 of the clip element of the mounting hook and clip 10.

FIG. 2 shows the progressive profile development, from an upper hook 13 through an intermediate (abutment) shoulder with opposed arms 14, 15 for (bearing upon the upper side of the fold 26 on the display card panel 21), to a downward leg 17, ending across a ledge 18, in a laterally offset tongue 19 with a tapered wedge nose 16.

Once the tongue 19 has penetrated the slot 29 from the rear of the card panel 21 and has emerged from and lies abutting the opposite (front) face of the card panel 21, the leg 17 lies abutting the rear of the card panel 21—leaving the ledge 18 nested within the slot 29.

Thus, the hook 10 successively penetrates the card panel 21 from alternate sides through two spaced slots 27, 29, leaving the hook 13 and tongue 19 on the same side of the panel 21 and the leg 17 to the opposite side. In this way the hook 10 and card 20 are mutually entrained.

The offset of the locking tongue 19, by the depth of the ledge 18, is of the order of the thickness of the card 20. Thus the entrained hook 10 and card 20 can lie more or less flat. Nevertheless, if required, other relative orientations of the hook region 13 and clip region 17, 18, 19 may be contrived.

The tapered nose 16 on the tongue 19 facilitates insertion of the tongue successively through the slots 27 and 29, with minimal bending of the card panel 21.

It will be apparent that the card 20 and hook 10 may readily be pre-assembled before attachment to a garment.

FIGS. 4 through 8 depict a composite mounting hook and clip 30 embodying some features of the stepped limb configuration of FIGS. 1 to 3, but with marginally-spaced side limbs, between which a folded display card and intervening garment may be inserted.

One side limb comprises an open generally rectangular peripheral frame 34 with a lower tapered nose and the opposite limb comprises a generally flat panel 37 carrying a lower depending, and laterally offset, locking tongue 39 with a tapered nose 36.

The panel 37 is marginally laterally offset from the plane of the hook 33 and the open frame 34 by an upper shoulder or ledge 35 and from the locking tongue 39 by a ledge 38.

The panel 37 forms an additional surface for display, and to it may be affixed a printed label—or indeed the panel may be inked direct by, say, pad printing.

A hook profile 33, with a re-entrant nose 32, extends from the shoulder 35, generally coplanar with the frame 34 and the locking tongue 39 in its undeflected condition.

Figure 6:
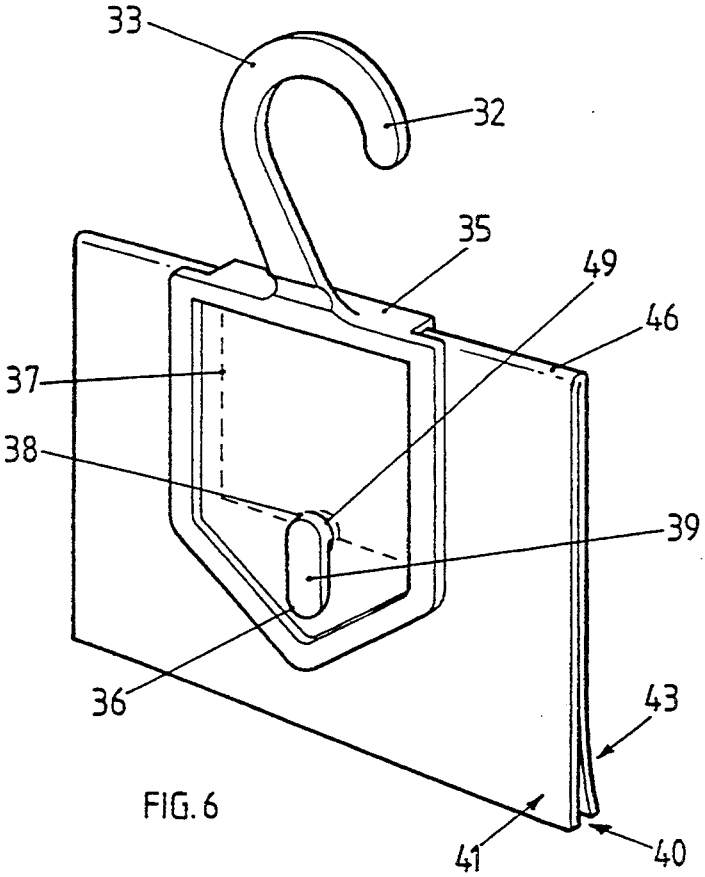
FIG. 6 shows the mounting hook of FIGS. 4 and 5 fitted into a display and mounting card.
Figure 7:
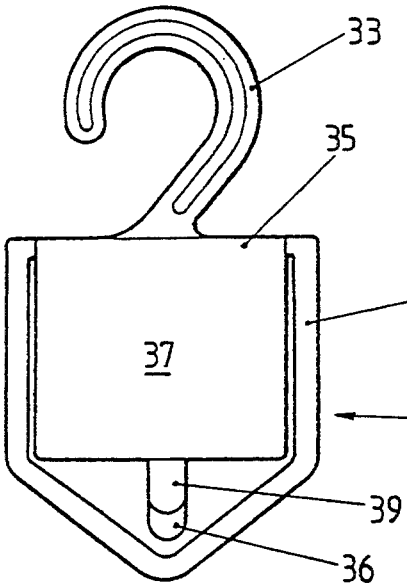
FIG. 7 shows a front elevation of the mounting hook and clip shown in FIGS. 4 to 6.
Figure 8:
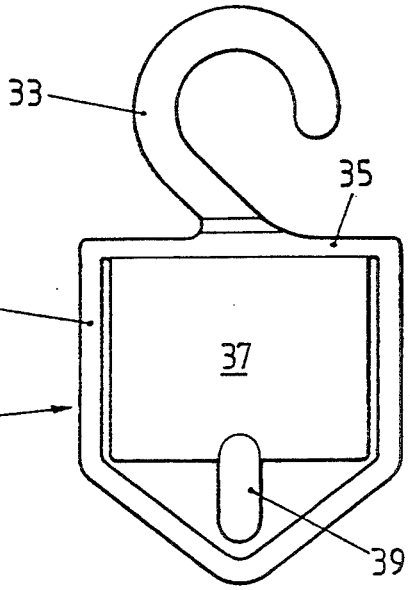
FIG. 8 shows a rear elevation of the mounting hook and clip shown in FIGS. 4 to 7.

The locking tongue 39 penetrates a slot 49 in a display card 40, which may comprise a folded sheet with a hinged spine 46 and opposite panels 41,43 as shown in FIG. 6, or single sheet.

One or both panels then hang through the walls of the slot 49 from the ledge 38 between the panel 37 and tongue 39. The folded card panels 41, 43 are discouraged from separating by the embrace of the opposed open frame 34 and panel 37.

Figure 9:
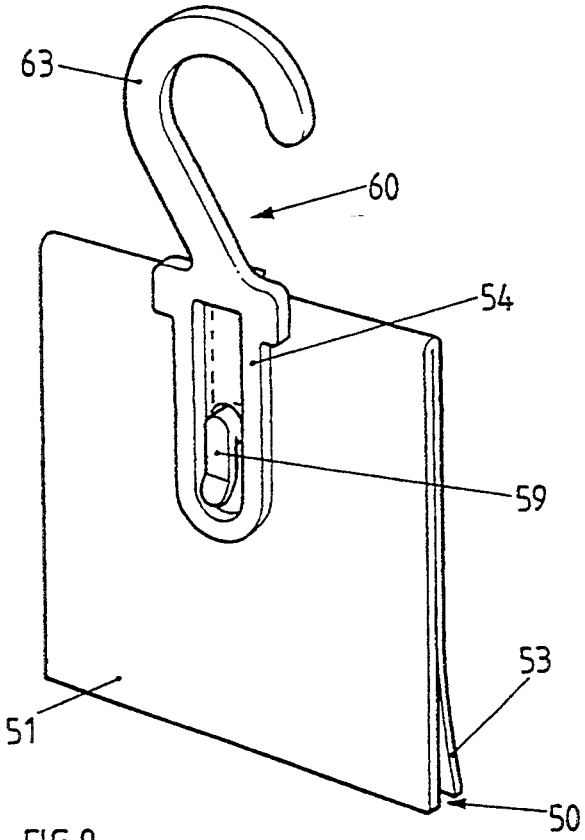
FIG. 9 shows yet another alternative mounting hook and clip to those shown in FIGS. 1 to 8 fitted into a display and mounting card.
Figure 10:
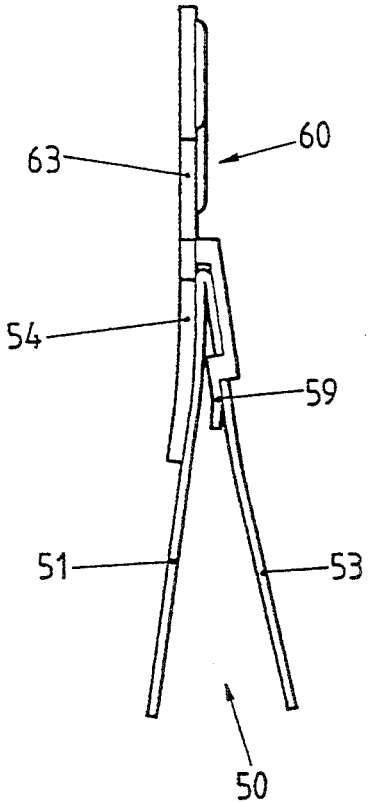
FIG. 10 shows a side elevation of the mounting hook and clip shown in FIG. 9.

FIGS. 9 and 10 show a variation 60 of the hook configuration shown in FIGS. 4 through 8, with a narrower open frame 54 and a double-ended latching tongue 59, surmounted by a hook 63 and entraining opposite panels 51, 53 of a folded display card 50.

It should be appreciated that the overall configuration of the hook and clip and the disposition of slots in the associated display card admit of considerable variation.

Thus, for example, in the FIGS. 1 to 3 embodiment, the entire hook and clip body may be reversed, so that the locking tongue 19 emerges on the inside of the card panel—in which case the leg 17, which is consequently exposed to the fore of the card panel, may be enlarged, or the shoulder 14, 15 extended, above the slot 27 and to the fore of the card panel, to provide a display panel, equivalent to the display panel 37 in the FIGS. 4 to 8 embodiment.

I claim:

1. The combination of a mounting hook and a folded mounting card for suspending an item between two facing panels of the folded mounting card, there being a hole in each of the two facing panels, said holes being aligned with each other, the mounting hook having a hook portion and a pair of laterally offset limbs depending from the hook portion, an interconnecting bridge spanning between said limbs and laterally offsetting one limb from the other, said other limb passing through both said holes with said one limb being disposed on an outer side of one said facing panel and the other said limb being disposed on the outer side of the other said facing panel and said bridge being disposed in said holes.

2. The combination of claim 1, further including horizontal arms extending from opposite sides of a juncture between said hook and said one limb.

3. The combination of claim 2, and a frame with a central opening depending from said arms and laterally spaced from said one limb, said frame being disposed in a plane and said other limb being offset to the same side as said plane from said one limb, said frame being disposed on the same side of said other facing panel as said other limb.

* * * * *